US012467181B2

(12) United States Patent
Lee et al.

(10) Patent No.: US 12,467,181 B2
(45) Date of Patent: Nov. 11, 2025

(54) DETECTING A PRESENCE OF A CLEANING AGENT DURING A SELF-CLEAN CYCLE OF A WASHING MACHINE APPLIANCE

(71) Applicant: Haier US Appliance Solutions, Inc., Wilmington, DE (US)

(72) Inventors: Yoojeong Lee, Seongnam-si (KR); Wonmyung Seo, Seongnam-si (KR); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 201 days.

(21) Appl. No.: 18/359,589

(22) Filed: Jul. 26, 2023

(65) Prior Publication Data

US 2025/0034775 A1 Jan. 30, 2025

(51) Int. Cl.

| | |
|---|---|
| ***D06F 33/37*** | (2020.01) |
| ***D06F 33/43*** | (2020.01) |
| ***D06F 101/20*** | (2020.01) |
| ***D06F 103/22*** | (2020.01) |
| ***D06F 103/44*** | (2020.01) |
| ***D06F 105/42*** | (2020.01) |
| ***D06F 105/54*** | (2020.01) |

(52) U.S. Cl.

CPC ..... *D06F 33/37* (2020.02); *D06F 33/43* (2020.02); *D06F 2101/20* (2020.02); *D06F 2103/22* (2020.02); *D06F 2103/44* (2020.02); *D06F 2105/42* (2020.02); *D06F 2105/54* (2020.02)

(58) Field of Classification Search

CPC ..... D06F 33/43; D06F 33/69; D06F 35/008; D06F 2103/22

See application file for complete search history.

(56) References Cited

U.S. PATENT DOCUMENTS

| | | | | |
|---|---|---|---|---|
| 9,587,345 | B2 | 3/2017 | Cho | |
| 2019/0301073 | A1 | 10/2019 | Kessler et al. | |
| 2020/0319092 | A1 * | 10/2020 | Schenkl | G05B 19/042 |
| 2020/0325620 | A1 * | 10/2020 | Chae | D06F 39/022 |

FOREIGN PATENT DOCUMENTS

| | | | | |
|---|---|---|---|---|
| CN | 110965262 | B | 5/2022 | |
| DE | 19751814 | A1 * | 6/1998 | D06F 35/008 |
| WO | WO2022146306 | A1 | 7/2022 | |

OTHER PUBLICATIONS

DE19751814A1 Machine Translation (Year: 1998).*

* cited by examiner

*Primary Examiner* — Spencer E. Bell
(74) *Attorney, Agent, or Firm* — Dority & Manning, P.A.

(57) ABSTRACT

A method for operating a washing machine appliance may comprise a step of monitoring, with a sensor, a conductivity measurement of a tub of the washing machine appliance. The method may also include a step of receiving an input indicative of a selection of a self-clean cycle of the washing machine appliance. The method may further include a step of activating the self-clean cycle of the washing machine appliance. The method may also include a step of recording the conductivity measurement of the tub in response to the self-clean cycle being activated. The method may further include a step of comparing the recorded conductivity measurement to a first reference conductivity value. The method may also include a step of determining, based on the compared recorded conductivity measurement and the first reference conductivity value, the presence of a cleaning agent within the tub.

17 Claims, 5 Drawing Sheets

300

| | CLEANING AGENT: DISINFECTANT | CLEANING AGENT: DETERGENT | AIR OR NO ADDITIVE IN THE TUB |
|---|---|---|---|
| CONDUCTIVITY | 8000 μS/cm | 2797 μS/cm | 0 μS/cm |

FIG. 3

DETECTING A PRESENCE OF A CLEANING AGENT DURING A SELF-CLEAN CYCLE OF A WASHING MACHINE APPLIANCE

FIELD

The present subject matter relates generally to washing machine appliances, and more particularly to systems and methods for detecting the presence of a cleaning agent during a self-clean cycle of a washing machine appliance.

BACKGROUND

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Washing machine appliances can operate in numerous cycles. For example, the typical washing machine appliance may be operable in various wash cycles, rinse cycles, drain cycles, spin cycles, and self-clean cycles. The self-clean cycle of the washing machine appliance is used to clean and sanitize the tub of the washing machine appliance by mitigating or eliminating residue and mold and mildew odors that may be present in the tub. In this regard, the self-clean cycle may require cleaning agents, for example, disinfectants, such as bleach, to be added to the tub such that the self-clean cycle may effectively clean and sanitize the tub by killing or inactivating bacteria and microorganisms within the tub that may result in the residue and mold and mildew odors.

However, in some cases, a user may not add the cleaning agent to the tub prior to operating the washing machine appliance in the self-clean cycle. Additionally, in some cases, a user may mistakenly add a substance, for example, a detergent or a cleaning agent that is not a disinfectant, to the tub instead of the proper cleaning agent prior to operating the washing machine appliance in the self-clean cycle. In such cases, the self-clean cycle may not properly or fully clean and sanitize the tub of the washing machine appliance.

Accordingly, systems and methods that may be used to operate a washing machine appliance would be beneficial. Particularly, an algorithm that may be used to detect the presence of a cleaning agent in the tub of the washing machine appliance during a self-clean cycle would be useful.

BRIEF DESCRIPTION

Aspects and advantages of the invention will be set forth in part in the following description, or may be apparent from the description, or may be learned through practice of the invention.

In one exemplary embodiment, a method for operating a washing machine appliance is provided. The method may include a step of monitoring, with a sensor, a conductivity measurement of a tub of the washing machine appliance. The method may also include a step of receiving an input indicative of a selection of a self-clean cycle of the washing machine appliance. The method may further include a step of activating the self-clean cycle of the washing machine appliance. The method may also include a step of recording the conductivity measurement of the tub in response to the self-clean cycle being activated. The method may further include a step of comparing the recorded conductivity measurement to a first reference conductivity value. The method may also include a step of determining, based on the compared recorded conductivity measurement and the first reference conductivity value, the presence of a cleaning agent within the tub.

In another exemplary embodiment, a washing machine appliance is provided. The washing machine appliance includes a tub. The washing machine appliance also includes a sensor disposed at the tub. The sensor is configured to continuously record a conductivity measurement of the tub. The washing machine appliance further includes a controller. The controller may be operable for: monitoring, with a sensor, a conductivity measurement of a tub of the washing machine appliance; receiving an input indicative of a selection of a self-clean cycle of the washing machine appliance; activating the self-clean cycle of the washing machine appliance; recording the conductivity measurement of the tub in response to the self-clean cycle being activated; comparing the recorded conductivity measurement to a first reference conductivity value; and determining, based on the compared recorded conductivity measurement and the first reference conductivity value, the presence of a cleaning agent within the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 3 provides a table of values that may be stored on a controller of the exemplary washing machine appliance of FIG. 1.

Figure 1:
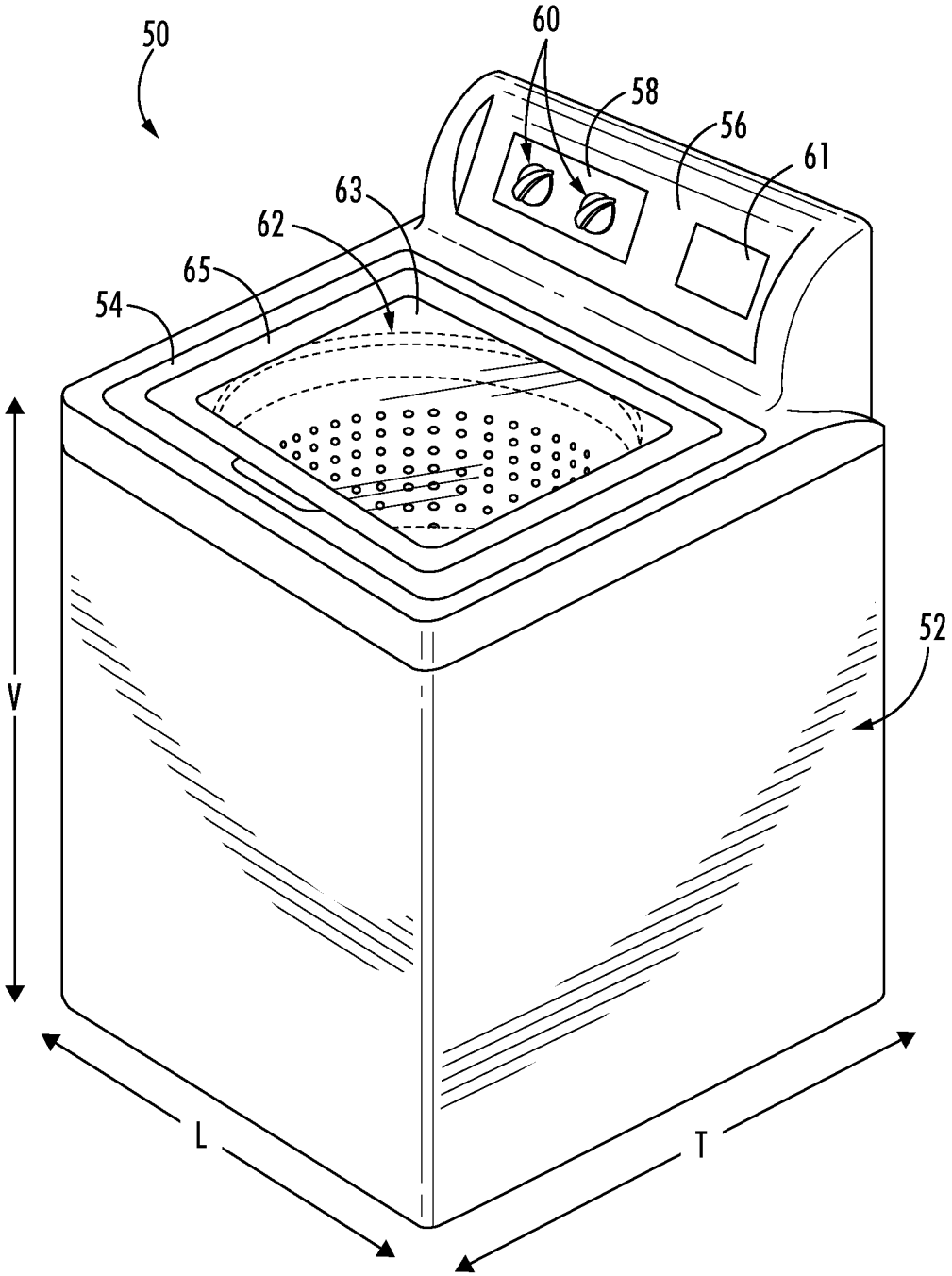
FIG. 1 provides a perspective view of a washing machine appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
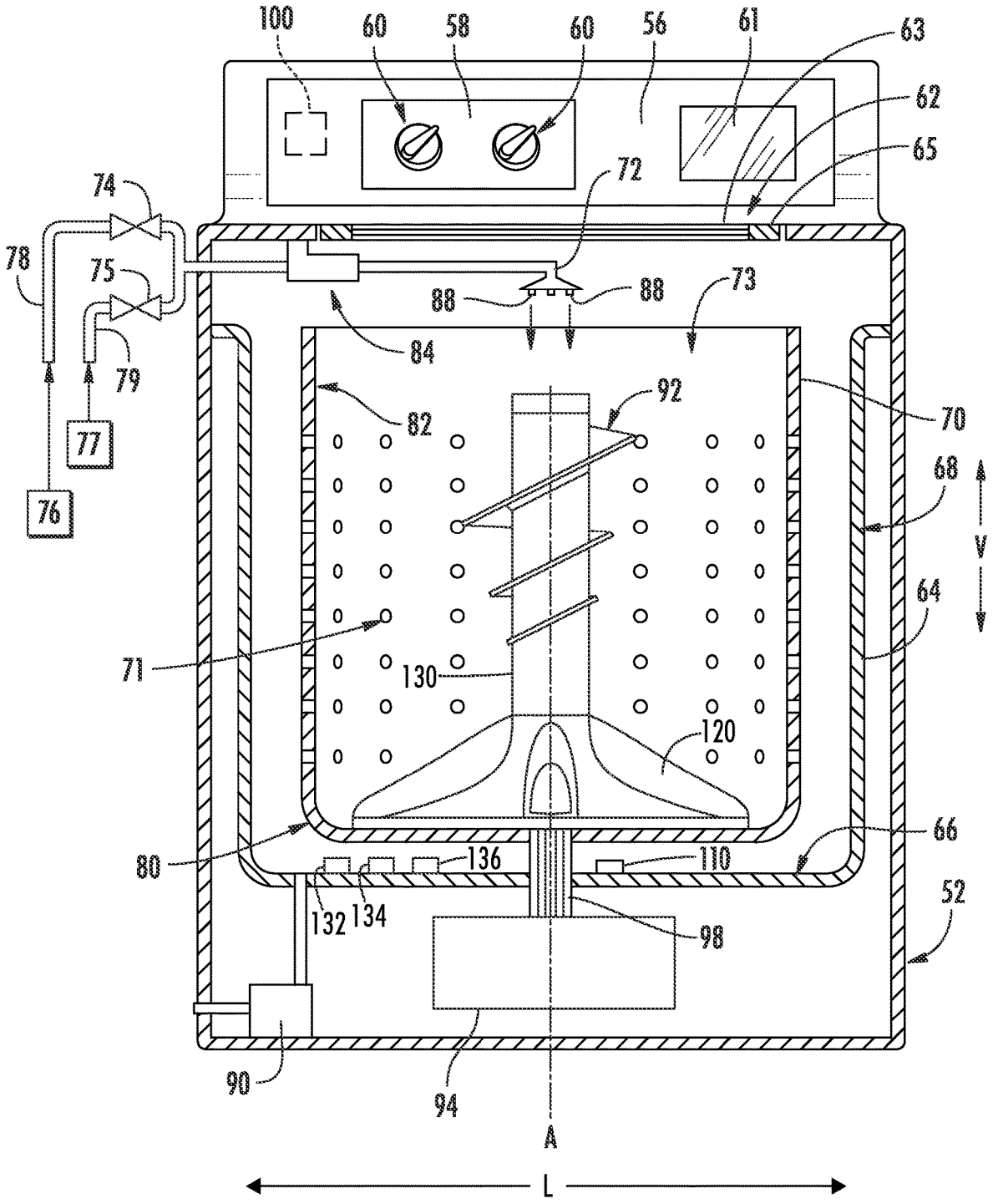
FIG. 2 provides a sectional elevation view of the exemplary washing machine appliance of FIG. 1.

Turning now to the figures, FIGS. 1 and 2 provide separate views of a washing machine appliance 50 according to example embodiments of the present disclosure. The washing machine appliance 50 may generally define a vertical direction V, a lateral direction L, and a transverse direction T. The vertical direction V, lateral direction L, and transverse direction T are each mutually perpendicular and form an orthogonal direction system.

One of ordinary skill in the art would understand that while described in the context of specific exemplary embodiment of the washing machine appliance 50, the present subject matter disclosed herein may be applicable to any suitable style, type, or configuration of washing machine appliance. For example, the present subject matter may also be applicable to front load washing machine appliances that may be commonly known in the art. Accordingly, the washing machine appliance 50 illustrated in FIGS. 1 and 2 may be provided by way of example only.

In some embodiments, the washing machine appliance 50 may include a cabinet 52 and a cover 54. In addition, a backsplash 56 may extend from cover 54, and a control panel 58, including a plurality of input selectors 60, may be coupled to the backsplash 56. In some embodiments, the control panel 58 and input selectors 60 may collectively form a user interface input for operator selection of machine cycles and features, and in one example embodiment, a display 61 may indicate selected features, a countdown timer, or other items of interest to machine users.

It should be appreciated, however, that in additional, or alternative, exemplary embodiments, the control panel 58, input selectors 60, and display 61, may have any other suitable configuration. For example, in other example embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub 64, which may also be referred to as a wash tub 64, located within cabinet 52 and a closed position (FIG. 1) forming an enclosure over tub 64. As illustrated in FIG. 1, the lid 62 may include a transparent panel 63. In some embodiments, the transparent panel 63 may be formed of, for example, glass, plastic, or any other suitable material. The transparency of the panel 63 allows users to see through the panel 63, and into the tub 64 when the lid 62 is in the closed position. In some exemplary embodiments, the panel 63 itself can generally form the lid 62. In other example embodiments, for instance, FIG. 1, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the example embodiment illustrated be a vertical axis. Thus, the exemplary washing machine appliance 50 may generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or may be holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

A dispenser 84 may additionally be provided for directing a wash additive, for example, liquid fabric softener, stain remover, whitening agents, scent boosters, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash additives directly to wash chamber 73. A pump assembly 90 (shown schematically in FIG. 2) may be located beneath tub 64 and basket 70 for gravity assisted flow to drain tub 64.

An agitation element 92 may be oriented to rotate about the rotation axis A (e.g., parallel to the vertical direction V). Generally, agitation element 92 includes an impeller base 120 and extended post 130. The agitation element 92 depicted may be positioned within the basket 70 to impart motion to the articles and liquid in the chamber 73 of the basket 70. More particularly, the agitation element 92 depicted may be provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) that may be selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Pump 90 may be configured to operate in response to pressure sensor 101 measuring a water level exceeding a limit value, e.g., a maximum fill value. In other words, controller 100 may be configured to operate pump 90 to remove fluid from tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

In addition to pressure sensor 110, washing machine appliance 50 may include various other sensors, for instance, the washing machine appliance may include a turbidity sensor 132, a conductivity sensor 134, and a temperature sensor 136. Each of the turbidity sensor 132, conductivity sensor 134, and temperature sensor 136 may be configured for signal communication with controller 100 described in more detail below. For example, each of the turbidity sensor 132, conductivity sensor 134, and temperature sensor 136 may send measurement data or signals to controller 100. In some example embodiments, the turbidity sensor 132, the conductivity sensor 134, and the temperature sensor 136 may be combined in any combination to reduce the total number of sensors in washing machine appliance 50. For instance, the turbidity sensor 132, the conductivity sensor 134, and the temperature sensor 136, may be combined into a single component, wherein the combination of the sensors may be referred to as a sensor assembly. Further, turbidity sensor 132, conductivity sensor 134, and temperature sensor 136 may be positioned in tub 64, e.g., on a bottom wall 66 of tub 64.

In some embodiments, the conductivity sensor 134 may be capable of detecting the presence of a cleaning agent, that may be present within the tub 64 of the washing machine appliance 50. As used herein a "cleaning agent" may generally refer to a substance or a mixture that may be formulated to remove dirt, stains, and other unwanted substances from various surfaces or materials. For instance, in some embodiments, the cleaning agent may be a detergent, for example, a liquid laundry detergent, that may generally include surfactants, which may help lift and remove dirt and grease from the surface of articles, for example, clothing articles. Additionally, or alternatively, in some embodiments, the cleaning agent may be a disinfectant, for example, bleach or other standalone disinfectants, that may contain antimicrobial properties. As will be understood, a disinfectant may preferably be used during a self-clean cycle of the washing machine appliance to remove residue dirt and grim build up that may have accumulated and/or mold and mildew odors from the tub 64 of the washing machine appliance 50.

Particularly, the self-clean cycle may be a cycle of the washing machine appliance 50, wherein the washing machine appliance 50, and more particularly, the tub 64 of the washing machine appliance 50 may be cleaned and sanitized. For instance, the self-clean cycle may be selected and activated by manipulation of the input selectors 60, for instance, by a user of the washing machine appliance 50. Further, once the self-clean cycle is selected and activated, a water filling step may occur wherein the tub 64 may be filled with liquid water. In some embodiments, the liquid water may be water with a relatively high temperature from the hot water source 76. For instance, the temperature of the liquid water from the water source may be greater than or equal to a temperature threshold as described in more detail below. In some embodiments, a cleaning agent, and more particularly, a disinfectant, may be added to the tub 64 prior to the selection and activation of the self-clean cycle. In such embodiments, during the water filling step, the disinfectant may be combined with the liquid water. In other embodiments, the cleaning agent may be dispensed into the tub 64 during the water filling step. For instance, in some embodiments, the cleaning agent may be provided into the tub 64 through the dispenser 84 such that the cleaning agent may be combined with the liquid water during the water filling step.

In addition, the self-clean cycle may include an agitation step and a soaking step. During the agitation step the washing machine appliance 50, and more particularly, the agitation element 92 may agitate liquid within the tub 64 to dislodge and dissolve dirt and residue that may have accumulated within the tub 64. During the soaking step the liquid, for example, the mixture of water and cleaning agent, may soak, for example, components of the tub 64 for a period of time.

Further, the self-clean cycle may include a rinse step and a drain step. During the rinse step and drain step the tub 64 of the washing machine appliance 50 may be rinsed with clean water and any remaining liquid within the tub 64 may be drained from the tub 64. For instance, after the agitation step and soaking step, dirty water that may have been accumulated in the tub 64 may be rinsed and drained from the tub.

The operation of washing machine appliance 50 and the numerous cycles thereof may be controlled by a processing device or controller 100, that may be operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), the motor 94, the pressure sensor 110, turbidity sensor 132, the conductivity sensor 134, the temperature sensor 136, etc. In response to user manipulation of the input selectors 60, controller 100 may operate the various components of washing machine appliance 50 to execute selected machine cycles and features.

In some embodiments, the controller 100 of washing machine appliance 50 may be configured to continuously monitor a conductivity measurement of the conductivity sensor 134. The conductivity measurement may be indicative of the conductivity of a fluid, for example, a wash fluid or a cleaning agent, that may be in the tub 64 of the washing machine appliance 50. Before adding the cleaning agent to the tub 64 and filling the tub 64 with a fluid, controller 100 may record an ambient conductivity measurement, for example, before the washing machine appliance 50 begins operation of the self-clean cycle, the ambient conductivity measurement of the air within the tub 64 may be recorded. During the self-clean cycle, the controller 100 may be configured to record a conductivity measurement from the conductivity sensor 134. These measurements may be recorded in response to the self-clean cycle being selected and started, for example, by a user manipulating the input selectors 60 to start the self-clean cycle of the washing machine appliance 50.

When the conductivity measurements are recorded, controller 100 may be configured to compare the conductivity measurement to a reference conductivity value. In some embodiments, when a fluid, for example, a cleaning agent, is present in the tub 64, the conductivity sensor 134 may record a conductivity measurement between approximately zero micro-Siemens per centimeter and approximately fifteen thousand micro-Siemens per centimeter (0 μS/cm-15,000 μS/cm).

Referring now to FIG. 3, an exemplary table 300 that may be stored in the memory of controller 100 according to one or more exemplary embodiments of the present subject matter is provided. The exemplary table 300 may include reference conductivity values of various fluids that may be present within the tub 64 of the washing machine appliance 50, for instance, prior to, during, or after a self-clean cycle of the washing machine appliance 50. One of ordinary skill in the art would understand that the reference conductivity values provided in the table 300 are provided by way of example only. In some embodiments, the reference conductivity values for a cleaning agent, such as a disinfectant and a detergent, and air may be a range of values that each may approximately correspond to a reference conductivity value provided in table 300. In some embodiments, the reference conductivity values may be dependent on the type of cleaning agent that may be used within the tub 64. For example, differing types of bleach, for instance, chlorine bleach and oxygen bleach, may have differing reference conductivity values.

With table 300 of FIG. 3 stored in the memory of controller 100, controller 100 may determine a presence of and a type of fluid that may be in tub 64 via the values of the conductivity measurement. For instance, the conductivity measurements of fluids that may be in the tub 64 may vary depending on the type of fluid. A cleaning agent that is a disinfectant, for example, bleach, may have a relatively high conductive measurement when compared to the conductivity measurement of a cleaning agent that is a detergent, or any other suitable substance, for example wash additives. This difference in the conductivity measurements of the various types of fluids may allow for the determination of the presence and type of a fluid to be made.

For example, as illustrated in FIG. 3, a conductivity measurement that may be approximately zero micro-Siemens per centimeter (0 μS/cm) may correspond to air. In this regard, an exemplary reference conductivity value for air may be approximately zero micro-Siemens per centimeter (0 μS/cm). As another example, as illustrated in FIG. 3, a conductivity measurement that may be approximately two thousand seven hundred and ninety seven micro-Siemens per centimeter (2,797 μS/cm) may correspond to a cleaning agent that is a detergent. In this regard, an exemplary reference conductivity value for a cleaning agent that is a detergent may be approximately two thousand seven hundred and ninety seven micro-Siemens per centimeter (2,797 μS/cm). As another example, as illustrated in FIG. 3, a conductivity measurement that may be approximately eight thousand micro-Siemens per centimeter (8,000 μS/cm) may correspond to a cleaning agent that is a disinfectant.

Figure 4:
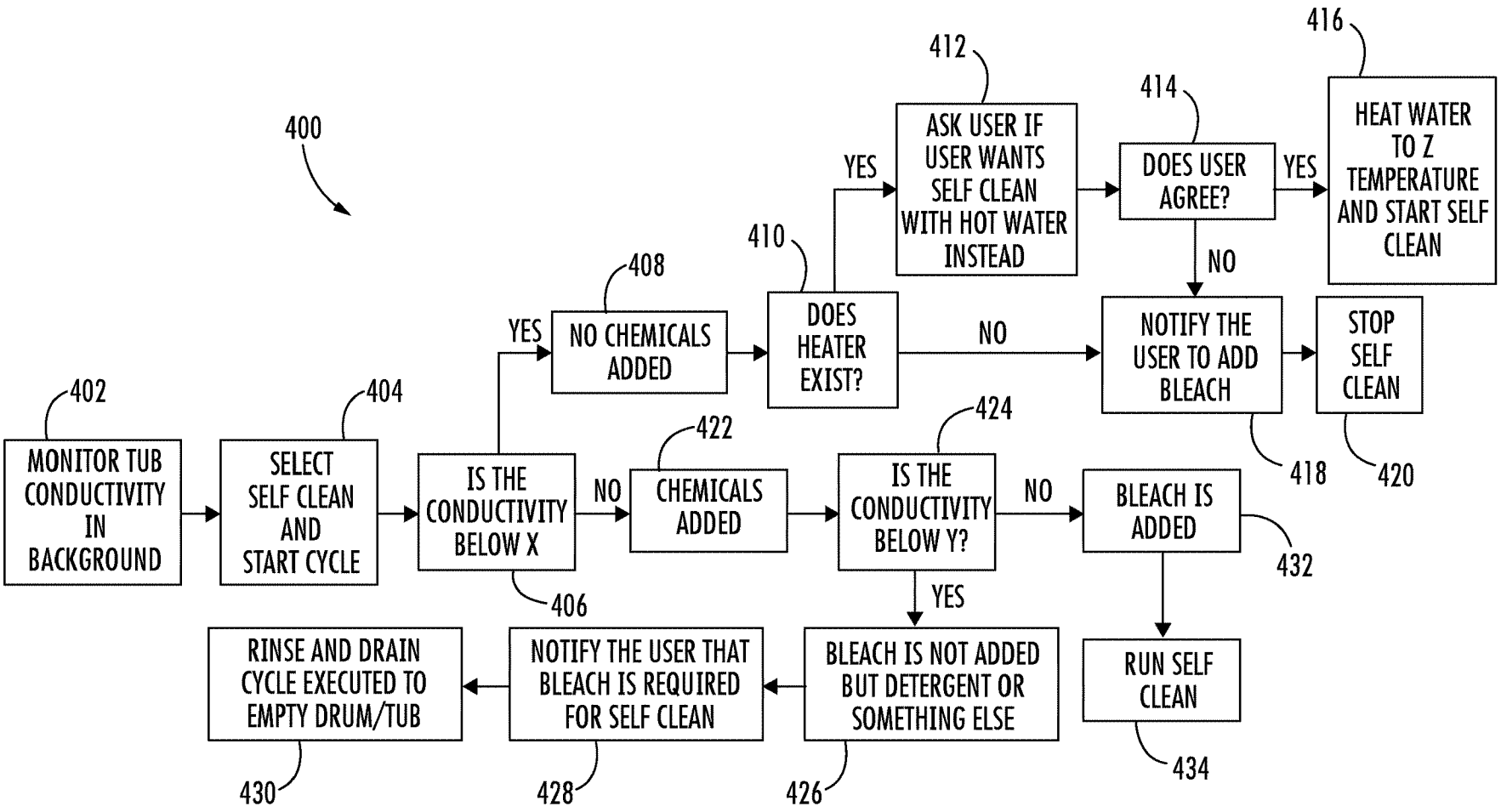
FIG. 4 provides a flow diagram of an algorithm that may be used to detect a presence of a cleaning agent during a self-clean cycle of a washing machine appliance according to one or more exemplary embodiments of the present subject matter.

Referring now to FIG. 4, a flow diagram of an algorithm 400 that may be used to operate a self-clean cycle of a washing machine appliance, such as the washing machine appliance 50, according to one or more exemplary embodiments of the present subject matter is provided. The algorithm 400 described herein, and illustrated in FIG. 4, may be implemented on any suitable washing machine appliance, for example, to operate the washing machine appliance. For instance, a controller of the washing machine appliance, such as the controller 100 of the washing machine appliance 50, may be operable for implementing the functions of the algorithm 400 such as to operate the washing machine appliance.

In some embodiments, the algorithm 400 may include a process function 402, wherein the conductivity measurement of the tub may be monitored in the background. For instance, as described above, the conductivity sensor may be configured to continuously monitor the conductivity measurement of the tub prior to the activation of the self-clean cycle of the washing machine appliance. The conductivity sensor may be configured to continuously observe and collect conductivity measurement data of the tub, and more particularly, of fluids that may be present within the tub.

The algorithm 400 may also include a process function 404, wherein the self-clean cycle may be selected, and wherein the self-clean cycle of the washing machine appliance may be activated. For instance, to select the self-clean cycle, a response indicative of a selection of the self-clean cycle may be received, for instance, by the controller 100. In some embodiments, the response indicative of the selection of the self-clean cycle may be a user manipulation of an input selector, for example, input selectors 60 of washing machine appliance 50, that may select a self-clean cycle of the washing machine appliance. Furthermore, a response indicative of an activation of the self-clean cycle may also be received, for instance, by the controller 100. In some embodiments, the response indicative of the initiation of the self-clean cycle may be a user manipulation of the input selectors that may initiate the self-clean cycle of the washing machine appliance. For example, a user may manipulate an input selector 60 of washing machine appliance 50 to activate the self-clean cycle of the washing machine appliance 50.

Once the self-clean cycle has been activated, the conductivity measurement of the tub may be recorded. In this regard, the algorithm 400 may further include a decision function 406, wherein it may be decided if a cleaning agent, a wash additive, or a combination thereof, has been added to or is present within the tub of the washing machine appliance. For instance, the decision function 406 may be configured to decide if a recorded conductivity measurement is below a first reference conductivity value. If the recorded conductivity measurement is below the first reference conductivity value, it may generally be decided at the decision function 406 that a cleaning agent, wash additive, or combination thereof, has not been added to the tub 64. In such cases, the process function 408 may be executed by the controller 100. Alternatively, if the recorded conductivity measurement is above the first reference conductivity value, for example, the recorded conductivity value is greater than or equal to the first reference conductivity value it may be decided, for instance, at the decision function 406, that the cleaning agent, wash additive, or combination thereof has been added to the tub 64. In such cases, the process function 422 may be executed by the controller 100.

In some embodiments, the first reference conductivity value may be approximately the reference conductivity value of a cleaning agent that is a detergent, for example, as depicted and described in FIG. 3. One of ordinary skill in the art, however, would understand the exemplary first reference conductivity value may be provided by way of example only. In alternative exemplary embodiments, any suitable first reference conductivity value may be provided. For instance, any suitable first reference conductivity value that may approximately correspond to the conductivity measurement of a cleaning agent that is a detergent may be provided.

In some embodiments, the algorithm 400 may further include a decision function 410, wherein the presence of a heater, for example, the heater may be internal or external, such as the hot water source 76 (e.g., a water heater appliance separate from the washing machine appliance) and/or a heating element, e.g., a resistance heating element such as a calrod, positioned in the washing machine appliance such as beneath the tub 64, is determined, for example, decided. In some embodiments, the decision function 410 may be in response to the process function 408 being executed. For instance, the decision function 410 may be in response to it being decided that the cleaning agent, wash additive, or combination thereof, has not been added to or is not present within the tub of the washing machine appliance.

In some embodiments, for instance, at the decision function 410, it may be decided that a hot water source is present and in fluid communication with the washing machine appliance. In such cases, a controller, for example, the controller 100, may execute a process function 412.

Alternatively, in some embodiments, for instance, at the decision function 410, it may be decided that a hot water source is not present or is otherwise not in fluid communication with the washing machine appliance. In such cases, a controller, for example, the controller 100, may execute process function 418, wherein a second user notification may be provided, for instance, to a user of the washing machine appliance. In some embodiments, the second user notification may be provided on the display of the washing machine appliance and/or on a remote user interface device. For instance, the second user notification may be a notification sent to a user's remote user interface device, for example, a user's smartphone, tablet, computer, smart watch, or any other device that may be connected to a network.

The second user notification may include a second prompt that may be provided to notify, for instance, a user of the washing machine appliance, that a cleaning agent that is a disinfectant may be required to be added to the tub of the washing machine appliance to continue the self-clean cycle. In addition, in response to the process function 418 being executed a process function 420 of the algorithm may be executed, wherein the self-clean cycle may be paused in response to the second user notification being provided.

The algorithm 400 may also include the process function 412, wherein a first user notification may be provided, for instance, to a user of the washing machine appliance. In some embodiments, the first user notification may be provided on the display of the washing machine appliance and/or on a remote user interface device. For instance, the first user notification may be a notification sent to a user's remote user interface device, for example, a user's smartphone, tablet, computer, smart watch, or any other device that may be connected to a network.

The first user notification may include a first prompt that may be provided to elicit a response, for instance, from a user of the washing machine appliance. In some embodiments, the first prompt may ask if a user wishes to use only hot water, for instance, in place of the cleaning agent, to clean and sanitize the tub 64 during the self-clean cycle.

In response to the process function 412 being executed and the first user notification being provided, a decision function 414 of the algorithm 400 may be executed, wherein an input indicative of a response to the first prompt may be received. For instance, the input may be indicative of a user's agreement or disagreement to the first user notification. In some embodiments, at the decision function 414, it may be decided that the self-clean cycle is to continue only using hot water. In such cases, the controller 100 may execute process function 416, wherein liquid water may be heated to a temperature threshold, for example, the liquid water from the hot water source 76 may be heated by one or both of an external heater and/or internal heater, as another example, the liquid water to be heated may be provided from the cold water source 77 as well as or instead of the hot water source 76. For example, the liquid water may be heated to a temperature that is greater than or equal to the temperature threshold described in more detail below, and wherein the self-clean cycle may be continued only using the hot water from the hot water source 76.

Alternatively, in some embodiments, at the decision function 414, it may be decided that the self-clean cycle is not to continue only using hot water. In such cases, the controller 100 may execute process function 418 and subsequently process function 420 as described in more detail above.

In some embodiments, at decision function 406, in response to it being decided that the recorded conductivity measurement is above, for example, greater than or equal to, the first reference conductivity value the algorithm 400 may include a process function 422, wherein it is determined a chemical, for example, a cleaning agent, has been added to or is present within the tub of the washing machine.

The algorithm 400 may also include a decision function 424, wherein the type of chemical that was added to or present within the tub of the washing machine appliance may be decided. For instance, the decision function 424 may be configured to decide if the recorded conductivity measurement is less than a second reference conductivity value. If the recorded conductivity measurement is not below the second reference conductivity value, for instance, if the recorded conductivity measurement is greater than or equal to the second reference conductivity value, it may be decided, at a process function 432, that a cleaning agent that is a disinfectant, for example, bleach, has been added to the tub of the washing machine appliance. In addition, in response to it being determined, at the process function 432, that the cleaning agent has been added to the tub of the washing machine appliance, a process function 434 may be executed wherein the self-clean cycle is continued and may be fully executed, for instance, the entire self-clean cycle as described in more detail above may be completed.

In some embodiments, the second reference conductivity value may be approximately the reference conductivity value of a cleaning agent that is a disinfectant, for example, as depicted and described in FIG. 3. One of ordinary skill in the art, however, would understand the exemplary second reference conductivity value may be provided by way of example only. In alternative exemplary embodiments, any suitable second reference conductivity value may be provided. For instance, any suitable second reference conductivity value that may approximately correspond to the conductivity measurement of a cleaning agent that is a disinfectant, for example, a commercially available cleaning agent that is a disinfectant, may be provided.

Alternatively, if the recorded conductivity measurement is below the second reference conductivity value, for instance, if the recorded conductivity measurement is less than the second reference conductivity value, it may be decided, at process function 426, that a cleaning agent that is a disinfectant has not been added to the tub of the washing machine appliance, but a cleaning agent that is a detergent or any other suitable wash additive, has been added to the tub.

The algorithm 400 may include a process function 426, wherein it may be determined that a cleaning agent that is a disinfectant has not been added to the tub 64, and wherein it may be determined that a cleaning agent that is a detergent or any other suitable wash additive was added to the tub. In some embodiments, the algorithm may further include a process function 428, wherein a third user notification may be provided, for instance, to a user of the washing machine appliance. In some embodiments, the third user notification may be provided on the display of the washing machine appliance and/or on a remote user interface device. For instance, the third user notification may be a notification sent to a user's remote user interface device, for example, a user's smartphone, tablet, computer, smart watch, or any other device that may be connected to a network.

The third user notification may include a third prompt that may be provided to notify the user that a second cleaning agent may be required to continue operation of the self-clean cycle. In some embodiments, the second cleaning agent may be required to be a disinfectant, for example, bleach. Furthermore, in response to the process function 428 being executed, the algorithm 400 may also include a process function 430, wherein a rinse cycle and a drain cycle (as described in more detail above) may be executed, for instance, to rinse and drain the tub of any liquid that may be present within the tub.

Figure 5:
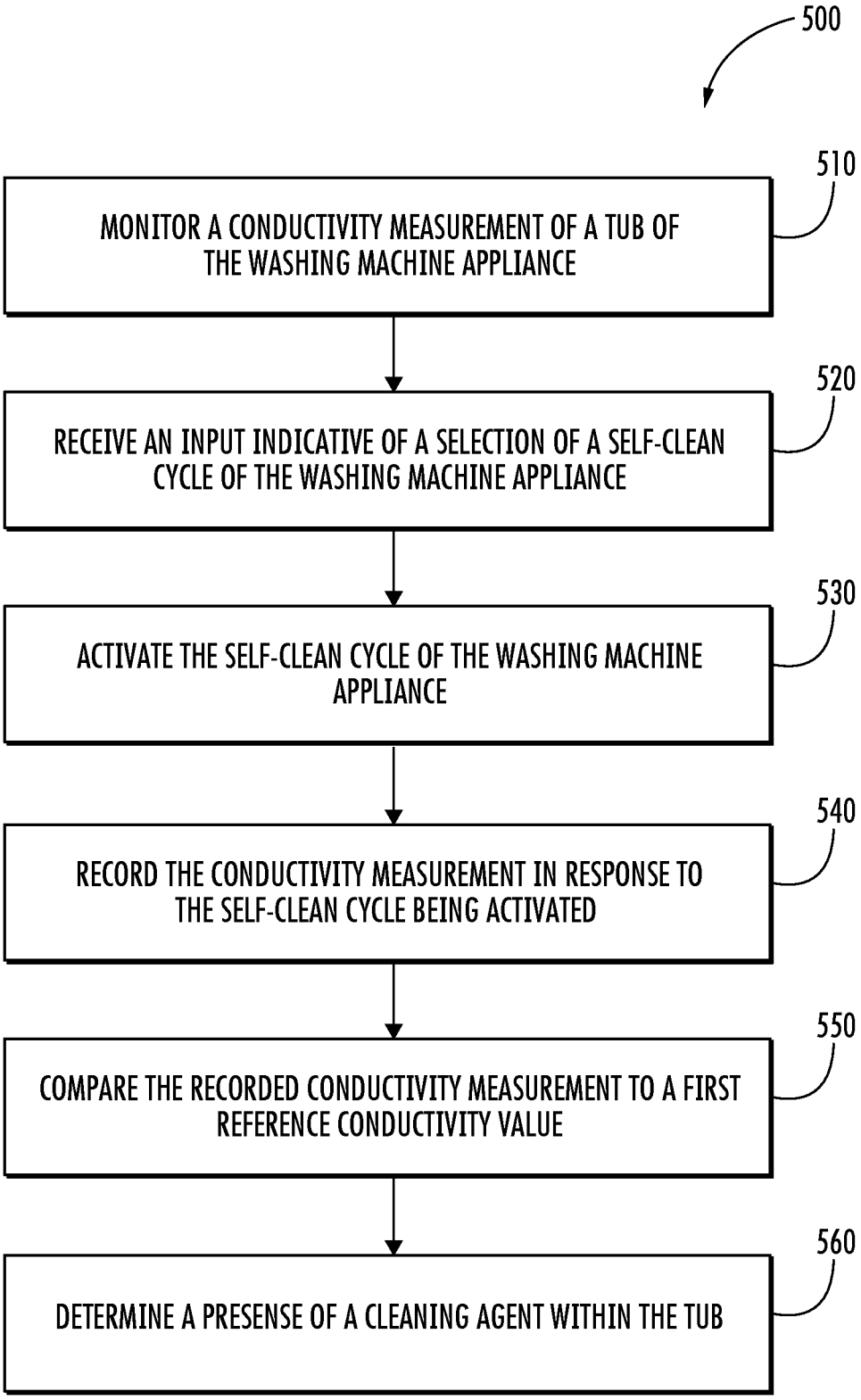
FIG. 5 provides a flow chart of an exemplary method of operating a washing machine appliance according to one or more exemplary embodiments of the present subject matter.

Referring now to FIG. 5, embodiments of the present subject matter may include one or more methods for operating a washing machine appliance, such as the exemplary washing machine appliance 50 described above, as well as other possible exemplary washing machine appliances. The exemplary methods according to the present subject matter may include a method 500, for example, as illustrated in FIG. 5. A controller of the washing machine appliance, such as the controller 100 of the exemplary washing machine 50, may be programmed to implement method 500, for example, the controller, such as controller 100, may be capable of and may be operable to perform any methods and associated method steps as disclosed herein.

In some embodiments, the method 500 may include a step 510 of monitoring, with a sensor, a conductivity measurement of a tub of the washing machine appliance. For instance, in some embodiments, the sensor may be a conductivity sensor, for example, the conductivity sensor 134 of the washing machine appliance. In some embodiments, the step 510 may include continuously sensing, for example, continuously observing and collecting data, the conductivity measurement of the tub in the background.

The method 500 may also include a step 520 of receiving an input indicative of a self-clean cycle of the washing machine appliance. In some embodiments, the input indicative of the self-clean cycle, may be provided by the manipulation of an input selector. For example, a user of the washing machine appliance 50 may manipulate input selector 60 to select the self-clean cycle of the washing machine appliance. In addition, the method 500 may further include a step 530 of activating the self-clean cycle of the washing machine appliance. In some embodiments activating the self-clean cycle of the washing machine appliance may include receiving an input indicative of the activation of the self-clean cycle of the washing machine appliance. For example, a user of the washing machine appliance 50 may manipulate the input selector 60 to activate the self-clean cycle.

The method 500 may also include a step 540 of recording, with the sensor, and more particularly, with a conductivity sensor, such as the conductivity sensor 134, the conductivity measurement of the tub in response to activating the self-clean cycle at step 530. Further, in response to the self-clean cycle being activated the method 500 may include a step 550 of comparing the recorded conductivity measurement to a first reference conductivity value. For instance, as described above, particularly with reference to decision function 406, the recorded conductivity measurement may be compared to the first reference conductivity value to determine if the recorded conductivity measurement is below the first reference conductivity value.

The method 500 may also include a step 560 of determining, based on the recorded conductivity measurement and the first reference conductivity value, the presence of a cleaning agent within the tub. As described above, in some embodiments, the cleaning agent may be a detergent, a wash additive, or any other suitable substance, and in additional, or alternative embodiments, the cleaning agent may be a disinfectant. In this regard, at step 560 it may also be determined the type of cleaning agent that may be present within the tub, for example, at step 560 it may be determined that the cleaning agent is a detergent, a wash additive, or any other suitable substance. As another example, at step 560 it may also be determined that the cleaning agent is a disinfectant, for example bleach.

In some instances, the recorded conductivity measurement may be less than the first reference conductivity value. In such instances, in response to the recorded conductivity measurement being less than the first reference conductivity value the step 560 of determining the presence of the cleaning agent may include determining that the cleaning agent is not present within the tub. In some embodiments, it may be determined that the cleaning agent is not present within the tub. Moreover, in some embodiments, when it may be determined that the cleaning agent is not present within the tub, the step 560 may further include a step of determining the presence of a hot water source in fluid communication with the washing machine appliance.

In some embodiments, the step of determining the presence of the hot water source may include determining that the hot water source is present and in fluid communication with the washing machine appliance. In some instances, it may be determined that a hot water source may be present and may be in fluid communication with the washing machine appliance. In such instances, a first user notification may be provided in response to it being determined that the hot water source may be present and may be in fluid communication with the washing machine appliance. The first user notification may include a first prompt. The first prompt may include a request to continue the self-clean cycle with liquid water from the hot water source.

In some embodiments, an input indicative of an affirmative response to the first prompt of the first user notification may be received. In such embodiments, the self-clean cycle may be continued only using liquid water from the hot water source, for example hot water source 76. In some embodiments, the liquid water from the hot water source may be heated to a temperature that may be greater than or equal to a temperature threshold. In some embodiments, the temperature threshold may be a temperature of liquid water that may effectively clean and disinfect the tub of the washing machine appliance. As one non-limiting example, in some embodiments, the temperature threshold may be approximately one hundred and forty degrees Fahrenheit (140° F.).

However, it should be appreciated that while hot liquid water, for example, liquid water at or above the temperature threshold, may be utilized in the self-clean cycle, in some instances, a cleaning agent that is a disinfectant may be required to be utilized to effectively remove all residue, bacteria, and/or odor that may be present within the washing machine appliance.

In other embodiments, an input indicative of a negative response to the first prompt of the first user notification may be received. In such embodiments, a second user notification may be provided, the second user notification may include a second prompt. The second prompt may include a request to add the cleaning agent to the tub of the washing machine appliance. For instance, the second prompt may request that a user add a cleaning agent that is a disinfectant, for example, bleach to the tub of the washing machine appliance as they may have previously indicated, for instance by inputting a negative response to the first user notification, that it is not desired to continue the self-clean cycle with only liquid water from the hot water source. In this regard, the self-clean cycle may also be paused, for instance, so that the user may add a cleaning agent that is a disinfectant, for example, bleach, to the tub of washing machine appliance. In some embodiments, the self-clean cycle may be resumed, for instance, by a user of the washing machine appliance, after a cleaning agent that is a disinfectant has been added to the tub.

In some embodiments, it is determined that a hot water source may not be present or may not be in fluid communication with the washing machine appliance. In such embodiments, the second user notification as described above may also be provided and the self-clean cycle may be paused.

In some embodiments, the recorded conductivity measurement may be greater than the first reference conductivity value for example, as compared at step 550. In such instances, the step 560 of determining, based on the compared recorded conductivity measurement and the first reference conductivity value the presence of the cleaning agent within the tub may further include a step of comparing the recorded conductivity measurement to a second reference conductivity value.

In some embodiments, the recorded conductivity measurement may be greater than the second reference conductivity value. In such embodiments, it may be determined that the cleaning agent is present within the tub, and the self-clean cycle may be fully executed.

In some embodiments, the recorded conductivity measurement may be less than the second reference conductivity value. In such embodiments, in response to the recorded conductivity measurement being less than the second reference conductivity value, the step 560 of determining the presence of the cleaning agent may include a step of determining that the cleaning agent is not present within the tub. In addition, in such embodiments, it may be determined that a cleaning agent that is a disinfectant is not present within the tub. A third user notification may be provided in response to it being determined that a cleaning agent that is a disinfectant is not present within the tub. The third user notification may include a third prompt. The third prompt may indicate, for example, to a user of the washing machine appliance, that a cleaning agent that is a disinfectant is required to operate the self-clean cycle. Further, a rinse cycle and a drain cycle may each be executed in response to the third user notification being provided.

As explained herein, aspects of the present subject matter are generally directed to systems and methods for operating a washing machine appliance. More particularly, the present subject matter includes systems and methods for detecting the presence and type of a cleaning agent in a tub of a washing machine appliance during a self-clean cycle. Further, as explained herein, the self-clean cycle in the washing machine appliance may be utilized to keep a tub of the washing machine appliance fresh and clean from mold and mildew odors. Preferably, to utilize the self-clean cycle, disinfectant, for example, bleach or specialized cleaners are added to the tub of the washing machine appliance. A conductivity sensor advantageously measures the conductivity of the tub to detect the presence of a cleaning agent within the tub, for instance, during the self-clean cycle. As conductivity measurements may differ amongst types of cleaning agents, the type of cleaning agent that may be present in the tub may advantageously be detected and may be used to advantageously help a user in correctly using the self-clean cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the method comprising:

monitoring, with a sensor, a conductivity measurement of a fluid in a tub of the washing machine appliance;

receiving an input indicative of a selection of a self-clean cycle of the washing machine appliance;

activating the self-clean cycle of the washing machine appliance;

recording the conductivity measurement of the fluid in the tub in response to the self-clean cycle being activated;

comparing the recorded conductivity measurement to a first reference conductivity value;

determining, based on the compared recorded conductivity measurement and the first reference conductivity value, a cleaning agent is not present within the tub;

determining a presence of a heater in response to determining the cleaning agent is not present within the tub; and providing a first user notification in response to it being determined that the heater is present, the first user notification comprising a first prompt comprising a request to continue the self-clean cycle with hot water.

2. The method of claim 1, wherein it is determined that the cleaning agent is not present within the tub when the recorded conductivity measurement is less than the first reference conductivity value.

3. The method of claim 1, further comprising:

receiving an input indicative of an affirmative response to the first user notification; and continuing the self-clean cycle with liquid water heated to a temperature greater than or equal to a temperature threshold in response to receiving the input.

4. The method of claim 1, further comprising:

receiving an input indicative of a negative response to the first user notification;

providing a second user notification in response to receiving the input, the second user notification comprising a second prompt comprising a request to add the cleaning agent to the tub of the washing machine appliance; and pausing the self-clean cycle.

5. The method of claim 1, further comprising:

providing a second user notification in response to it being determined that the heater is not present, the second user notification comprising a second prompt comprising a request to add the cleaning agent to the tub of the washing machine appliance; and pausing the self-clean cycle.

6. A washing machine appliance comprising:

a tub;

a conductivity sensor positioned in the tub on a bottom wall of the tub, the conductivity sensor is configured to continuously record a conductivity measurement of a fluid in the tub; and a controller operable for:

monitoring, with the conductivity sensor, a conductivity measurement of a fluid in the tub of the washing machine appliance;

receiving an input indicative of a selection of a self-clean cycle of the washing machine appliance;

activating the self-clean cycle of the washing machine appliance;

recording the conductivity measurement of the fluid in the tub in response to the self-clean cycle being activated;

comparing the recorded conductivity measurement to a first reference conductivity value; and determining, based on the compared recorded conductivity measurement and the first reference conductivity value, a presence of a cleaning agent within the tub;

comparing the recorded conductivity measurement to a second reference conductivity value in response to determining the cleaning agent is present within the tub;

determining, based on the compared recorded conductivity measurement and the second reference conductivity value, the cleaning agent present within the tub is a detergent; and providing a user notification in response to determining that the cleaning agent is a detergent, the user notification comprising a prompt indicating that a second cleaning agent is required to operate the self-clean cycle, wherein the second cleaning agent is a disinfectant.

7. The washing machine appliance of claim 6, wherein it is determined that the cleaning agent is present within the tub when the recorded conductivity measurement is greater than or equal to the first reference conductivity value.

8. The washing machine appliance of claim 6, wherein it is determined that the cleaning agent present within the tub is the detergent when the recorded conductivity measurement is less than the second reference conductivity value.

9. The washing machine appliance of claim 6, further comprising:

determining, based on the compared recorded conductivity measurement and the second reference conductivity value, the cleaning agent present within the tub is a disinfectant; and fully executing the self-clean cycle in response to determining the cleaning agent present within the tub is a disinfectant.

10. The washing machine appliance of claim 9, wherein it is determined that the cleaning agent present within the tub is the disinfectant when the recorded conductivity measurement is greater than or equal to the second reference conductivity value.

11. The washing machine appliance of claim 6, further comprising:

executing a rinse cycle and a drain cycle in response to the providing the user notification.

12. A method for operating a washing machine appliance, the method comprising:

monitoring, with a sensor, a conductivity measurement of a fluid in a tub of the washing machine appliance;

receiving an input indicative of a selection of a self-clean cycle of the washing machine appliance;

activating the self-clean cycle of the washing machine appliance;

recording the conductivity measurement of the fluid in the tub in response to the self-clean cycle being activated;

comparing the recorded conductivity measurement to a first reference conductivity value;

determining, based on the compared recorded conductivity measurement and the first reference conductivity value, a cleaning agent is present within the tub;

comparing the recorded conductivity measurement to a second reference conductivity value in response to determining the cleaning agent is present within the tub;

determining, based on the compared recorded conductivity measurement and the second reference conductivity value, the cleaning agent present within the tub is a detergent; and providing a user notification in response to determining the cleaning agent present within the tub is a detergent, the user notification comprising a prompt indicating that a second cleaning agent is required to operate the self-clean cycle, wherein the second cleaning agent is a disinfectant.

13. The method of claim 12, wherein it is determined that the cleaning agent is present within the tub when the recorded conductivity measurement is greater than or equal to the first reference conductivity value.

14. The method of claim 12, wherein it is determined that the cleaning agent present within the tub is the detergent when the recorded conductivity measurement is less than the second reference conductivity value.

15. The method of claim 12, further comprising:

determining, based on the compared recorded conductivity measurement and the second reference conductivity value, the cleaning agent present within the tub is a disinfectant; and fully executing the self-clean cycle in response to determining the cleaning agent present within the tub is a disinfectant.

16. The method of claim 15, wherein it is determined that the cleaning agent present within the tub is the disinfectant when the recorded conductivity measurement is greater than or equal to the second reference conductivity value.

17. The method of claim 12, further comprising:

executing a rinse cycle and a drain cycle in response to the providing the user notification.

* * * * *